United States Patent [19]

Ebeling et al.

[11] 4,090,626

[45] May 23, 1978

[54] TRASH HANDLING DEVICE

[76] Inventors: Franklin D. Ebeling; Ernest C. Ebeling, both of 1608 W. 24th St., Plainview, Tex. 79072

[21] Appl. No.: 733,083

[22] Filed: Oct. 18, 1976

Related U.S. Application Data

[63] Continuation-in-part of Ser. No. 644,768, Dec. 29, 1975, abandoned, which is a continuation of Ser. No. 546,277, Feb. 3, 1975, Pat. No. 3,944,092, which is a continuation of Ser. No. 471,845, May 21, 1974, abandoned.

[51] Int. Cl.[2] ..... B65F 3/02

[52] U.S. Cl. ..... 214/302; 214/313

[58] Field of Search ..... 214/302, 303, 313, 670, 214/671, 147 G

[56] References Cited

U.S. PATENT DOCUMENTS

| | | | |
|---|---|---|---|
| 2,877,910 | 3/1959 | Nelson | 214/302 |
| 3,040,919 | 6/1962 | Noland | 214/302 |
| 3,136,436 | 6/1964 | Erlinder et al. | 214/302 |
| 3,458,071 | 7/1969 | Smith | 214/302 |
| 3,520,428 | 7/1970 | Puckett | 214/302 |
| 3,732,997 | 5/1973 | Reavis et al. | 214/302 |
| 3,773,197 | 11/1973 | Blakeley et al. | 214/302 |
| 3,790,011 | 2/1974 | Owen, Jr. | 214/302 |
| 3,910,434 | 10/1975 | Ebeling et al. | 214/302 |
| 3,931,901 | 1/1976 | Jones | 214/302 |

*Primary Examiner*—Lawrence J. Oresky
*Attorney, Agent, or Firm*—Wayland D. Keith; Max E. Shirk

[57] ABSTRACT

An interchangeable container emptying device on the side of a trash-hauling vehicle to a position adjacent support abutment means on a trash container to move open-throat portions of U-shaped members upwardly into engagement with support abutment means, elevates container, automatically blocks open-throat portions of the U-shaped members to prevent disengagement of support abutment means when container reached an arcuate turn at the top, inverts container to a dumping position, dumps container, moves container to an upright position, lowers container, and then moves container outwardly to its original position.

9 Claims, 19 Drawing Figures

TRASH HANDLING DEVICE

CROSS REFERENCE TO RELATED APPLICATIONS

This is a continuation-in-part of application Ser. No. 644,768, filed Dec. 29, 1975 now abandoned as a continuation application of application Ser. No. 546,277, filed Feb. 3, 1975, now U.S. Pat. No. 3,944,092, issued 3/16/76 which was a continuation of application Ser. No. 471,845, filed May 21, 1974 and now abandoned.

BACKGROUND OF THE INVENTION

The background of the invention will be set forth in two parts.

1. Field of the Invention

The present invention pertains generally to the field of trash handling devices and more particularly to a new and useful device for collecting trash and depositing it in a trash-hauling vehicle through an elevated access opening in the vehicle body.

2. OF THE Description of the Prior Art

Blakeley, et al U.S. Pat. No. 3,773,197; Owen U.S. Pat. No. 3,790,011 and applicants' U.S. Pat. No. 3,910,434 disclose container emptying devices including container engaging mechanisms having the capability of horizontal movement from the side of a vehicle to a trash container.

Nelson U.S. Pat. No. 2,877,910 discloses a trash container having support abutment means in the form of an arm affixed to each sidewall of the container in a horizontal plane. Each arm has a free end extending beyond the front wall of the container. A roller is rotatably mounted on the free end of each arm for rolling engagement with a vertical plate on the truck as cables, which may be hooked onto the horizontal arms, pull the container up the side of the truck.

OBJECTS AND SUMMARY OF THE INVENTION

It is a primary object of the present invention to provide a new and useful trash handling device exemplifying improvements over this prior art.

Another object of the present invention is to provide a container engaging mechanism of the type disclosed in U.S. Pat. No. 3,910,434 which is designed to coact with support abutment means of the type disclosed in U.S. Pat. No. 2,877,910 so that trash or refuse may be transferred from a container to a vehicle through an elevated access opening efficiently, expeditiously and economically.

Yet another object of the invention is to provide an interchangeable container emptying device which may be easily and speedily attached to an elevator device on a vehicle and which includes a new and useful locking container emptying device when the container is tipped to a dumping position adjacent an elevated access opening in the body of the vehicle.

According to the present invention, a new and useful apparatus for emptying the contents of trash and/or refuse containers into a vehicle through an elevated access opening in the vehicle body is provided. The apparatus may be used in combination with a vehicle having power supply means to empty trash and/or refuse containers.

The apparatus includes elevator means for raising and lowering the container. The elevator means includes an upper end adjacent the elevated access opening and a lower end adjacent a surface supporting the containers.

The apparatus also includs means connecting the elevator means to the power supply means for moving at least the lower end of the elevator means over the surface between a first position closely adjacent the vehicle and a second position spaced laterally outwardly from the vehicle and closely adjacent the container.

A container engaging means is connected to the elevator means for mechanically engaging support abutment means on the container when the elevator means is moved to the second position by the power supply means. The support abutment means on the container may include arms and rollers of the type disclosed in U.S. Pat. No. 2,877,910 and may be engaged by the open-throat portions of U-shaped members provided on the container engaging means.

The apparatus also includes locking means for automatically locking the support abutment means to the container engaging means so that the container will remain in connected relationship with the container engaging means when it is inverted adjacent the elevated access opening to empty the container.

In one form of the invention, the locking means is swingably connected to the container engaging means by suitable shaft means and includes lock bar means for bridging the open-throat portions of the U-shaped members. The locking means also includes bumper means engageable by the container for swinging the locking means about the shaft means upon movement of the container to the inverted position, so that the lock bar means will move to the bridging position. In this form of the invention, the rollers on the container are engaged by the U-shaped members.

In a modified form of the invention, the U-shaped members occupy a position on a container engaging means at right angles to the positions occupied by the U-shaped members in the first form of the invention so that the U-shaped members in the modified form will engage the arms behind the rollers. The locking means in the modified form of the invention includes a lock bar which is forced into engagement with each arm adjacent an associated one of the open-throat portions of the U-shaped members.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

DESCRIPTION OF THE PREFERRED EMBODIMENTS

Figure 1:
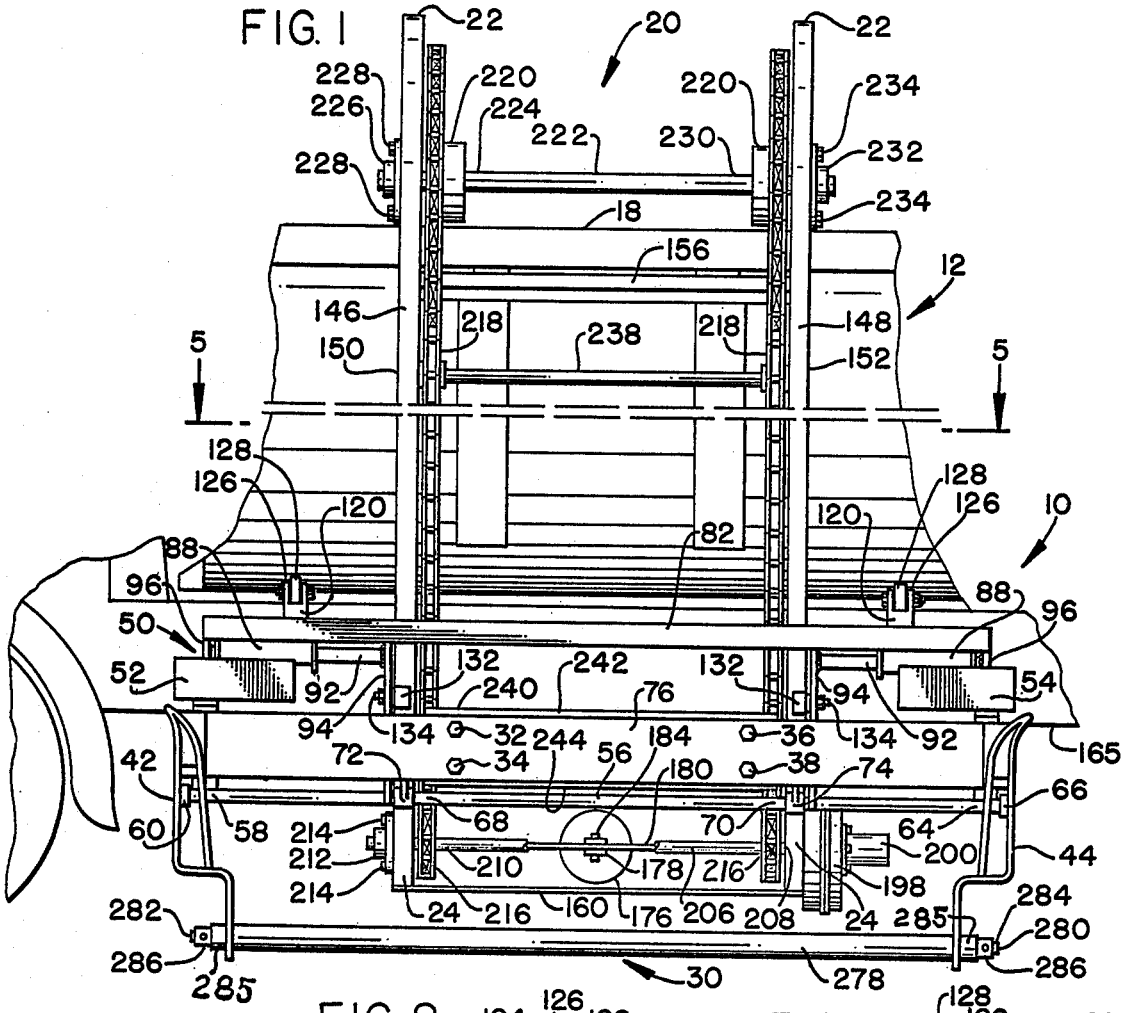
FIG. 1 is a front elevational view of a container emptying device constituting a first form of the present invention having portions thereof foreshortened for clarity and showing the device in position on the side of a vehicle shown in side elevation with portions broken away.
Figures 5, 6, 7, 8:
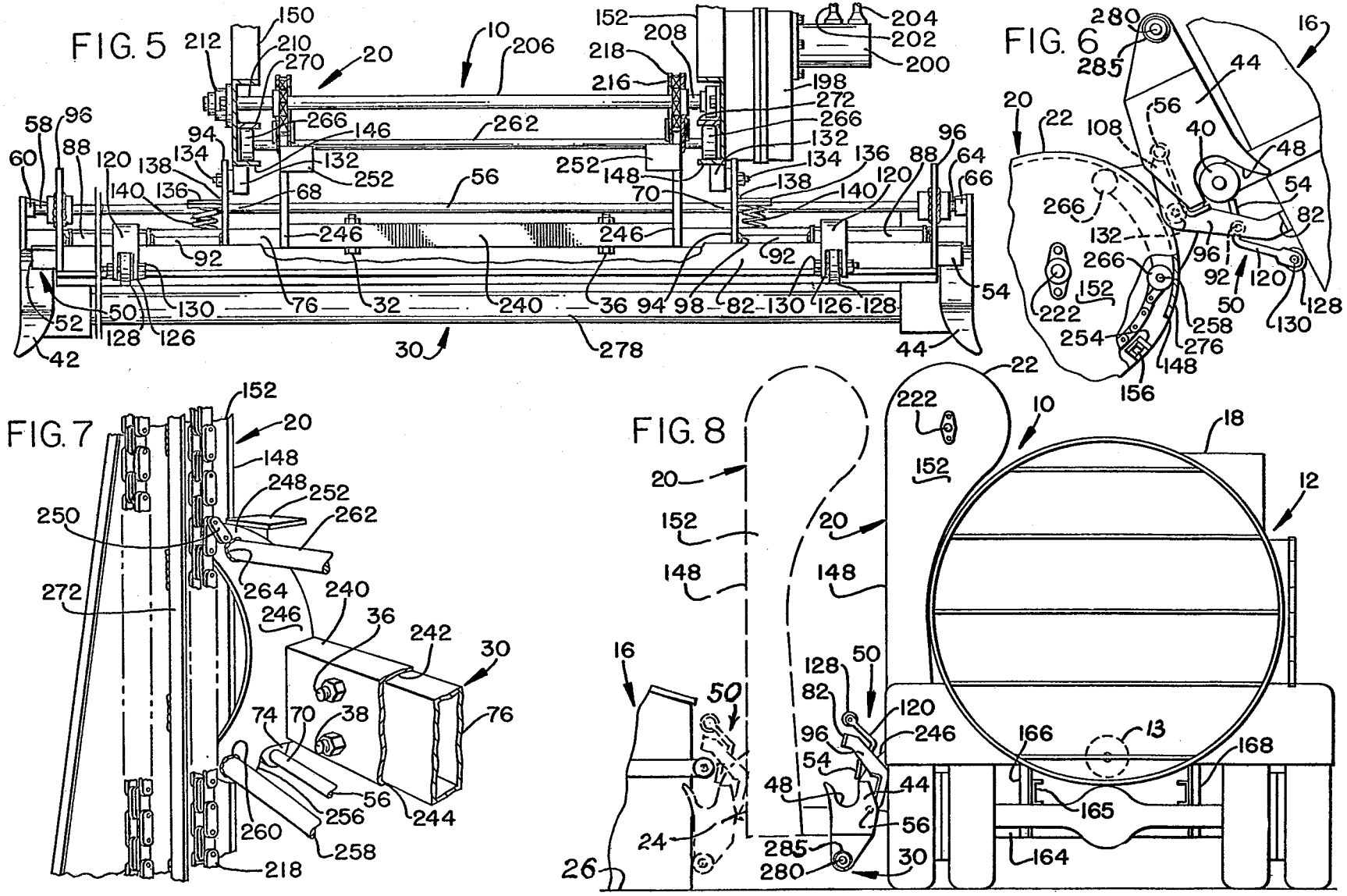
FIG. 5 is an enlarged, cross-sectional view taken along line 5—5 of FIG. 1.
FIG. 6 is an enlarged, partial side-elevational view showing a container connected to the device with the container in a tipped-dumping position.
FIG. 7 is an enlarged, partial perspective view of the device of FIG. 1 showing bolt means for connecting the container-engaging portion of the device to the elevator portion of the device.
FIG. 8 is a rear elevational view showing the device of FIG. 1 in position closely adjacent the truck of FIG. 1 in solid lines and in a laterally outward position in broken lines adjacent a partial elevational view of a container to be engaged by the device.
Figures 9, 10:
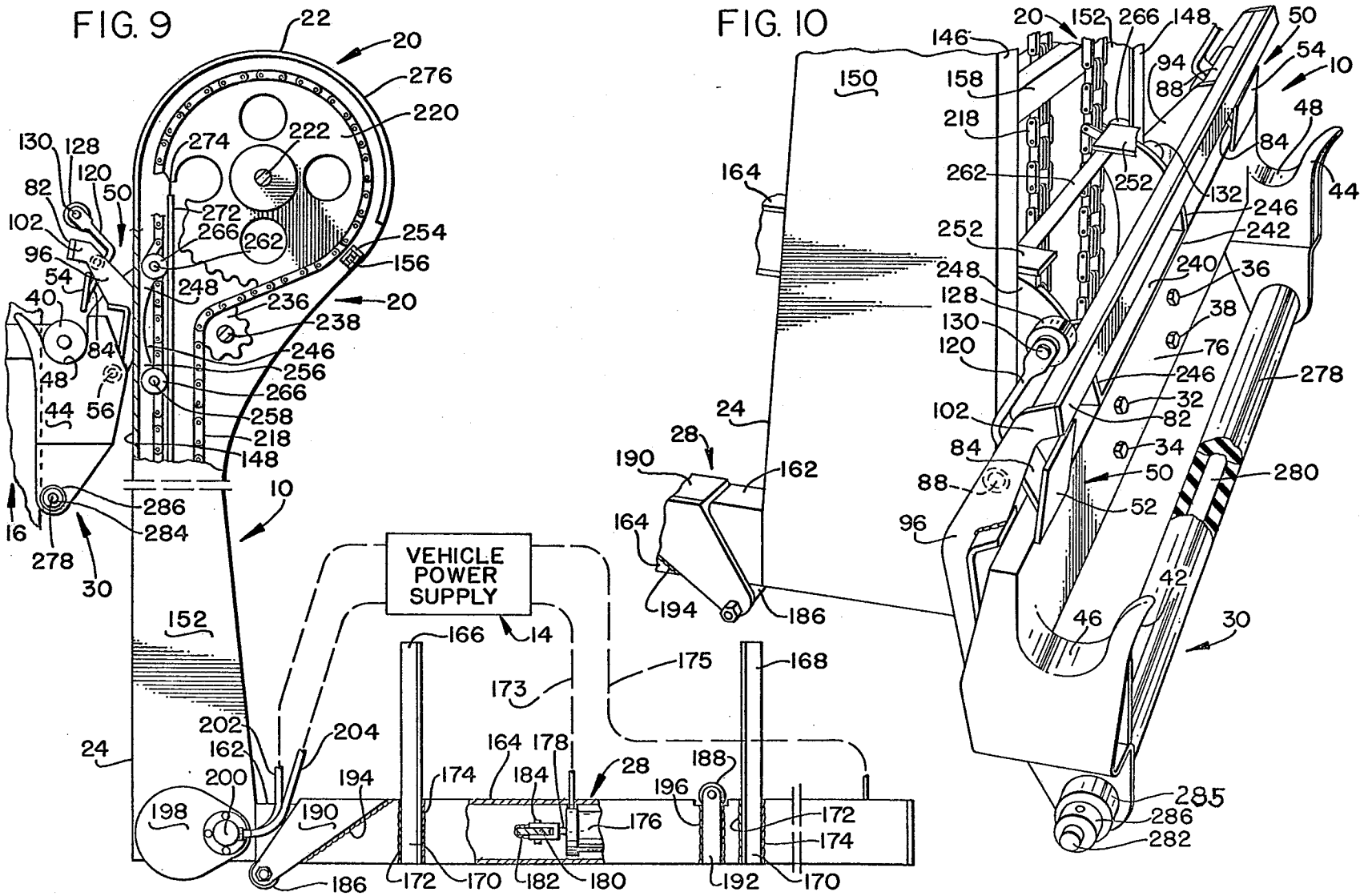
FIG. 9 is an enlarged elevational view, with parts broken away to show internal construction, of the device of FIG. 1 showing the container-engaging portion of the device in engagement with a container.
FIG. 10 is an enlarged partial perspective view showing the container-engaging portion of the device connected to the elevator portion of the device.
Figures 13, 14, 14A, 14B, 15, 16:
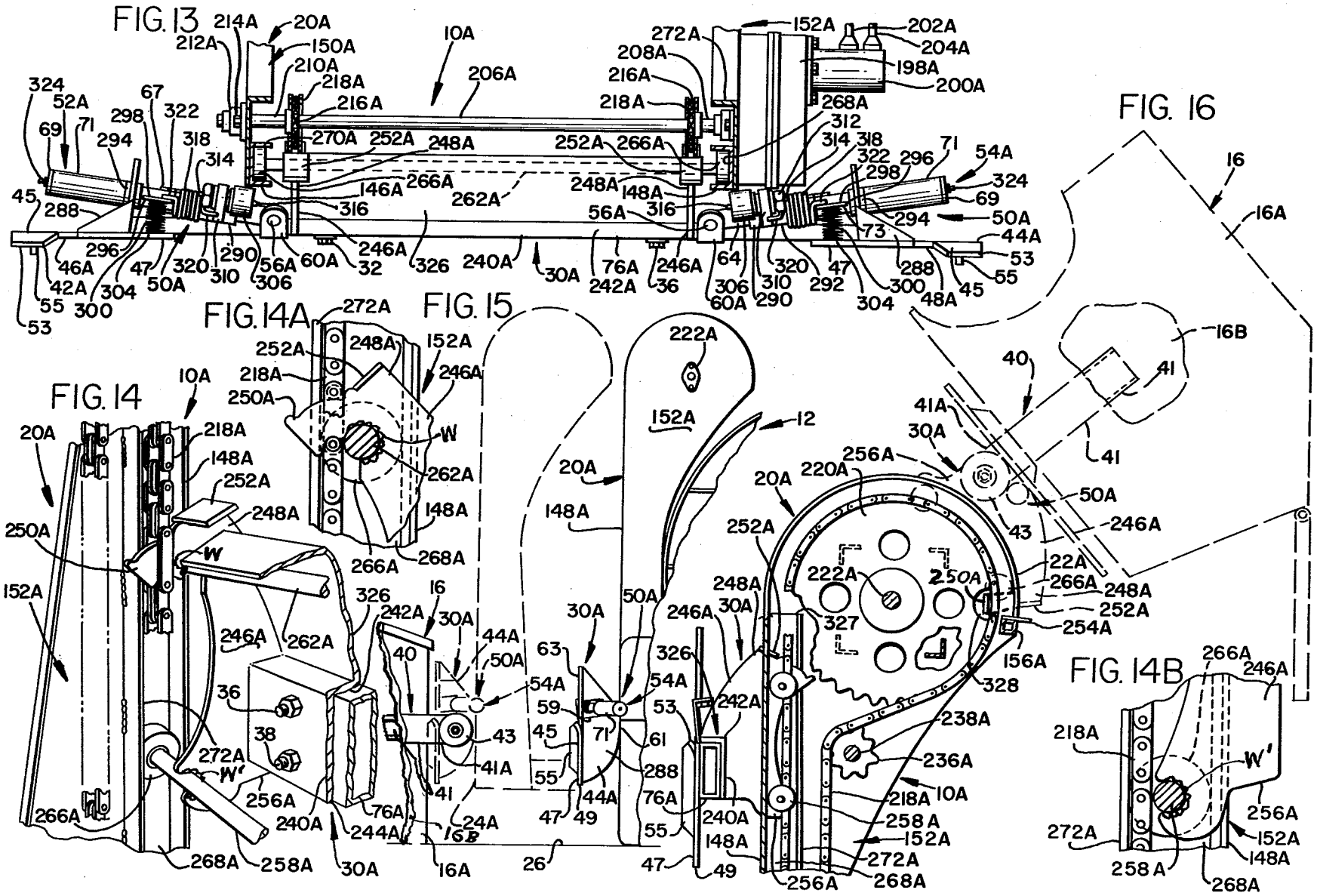
FIG. 13 is an enlarged cross-sectional view taken along line 13—13 of FIG. 11.
FIG. 14 is an enlarged, partial perspective view of the device of FIG. 11 showing hook means connecting the container-engaging portion of the device to the elevator portion of the device.
FIGS. 14A and 14B are partial, side-elevational views of the portion of the container-engaging mechanism shown in FIG. 14.
FIG. 15 is a rear elevational view showing the device of FIG. 11 in position closely adjacent the truck of FIG. 11 in solid lines and in a laterally outward position in broken lines adjacent a partial elevational view of a container to be engaged by the device.
FIG. 16 is an enlarged elevational view, with parts broken away to show internal construction, of the device of FIG. 11 showing the device detached from the truck and showing the container-engaging portion of the device in engagement with a container.

Referring again to the drawings, and more particularly to FIGS. 1 and 8, a container emptying device constituting a presently preferred embodiment of the invention, generally designated 10, is shown, for purposes of illustration, but not of limitation, in combination with a vehicle 12 having a suitable power supply, indicated schematically in FIG. 9 and 14 and fully illustrated and described in U.S. Pat. No. 3,910,434.

The container emptying device 10 is adapted to empty the contents of a trash container 16 (FIGS. 6, 8 and 9) into vehicle 12 through an elevatd access opening 18 provided therein. Device 10 includes a suitable elevator means 20 for raising and lowering container 16 and including an upper end 22 adjacent access opening 18 and a lower end 24 adjacent a supporting surface 26 which supports container 16 laterally outwardly from vehicle 12.

Container emptying device 10 also includes a suitable connecting means, indicated generally at 28 in FIG. 9, for connecting the elevator means 20 to the vehicle power supply 14 for moving at least the lower end 24 of elevator means 20 over surface 26 between a first position closely adjacent vehicle 12, as shown in solid lines in FIG. 8, and a second position spaced laterally outwardly from vehicle 12 and closely adjacent container 15, as shown in broken lines in FIG. 8

Device 10 also includes a container-engaging means 30 which may be quickly and easily connected to elevator means 20 by a plurality of bolts 32, 34, 36 and 38 facilitating interchanging container-engaging means 30 with other container engaging means like, for example the container engaging means shown in said U.S. Pat. No. 3,910,434. Container engaging means 30 is adapted to mechanically engage a suitable outwardly extending, transversely aligned abutment means which forms supporting means 40 provided on container 16 (FIGS. 6, 8 and 9) when the elevator means 20 is moved to the position shown in broken lines in FIG. 8 by power transmitted from vehicle power supply 14 to connecting means 28.

As best shown in FIGS. 2, 6, 8, 9 and 10, container-engaging means 30 includes a pair of hooks or U-shaped members 42, 44 having open-throat portions 46, 48, respectively, through which an associated one of the support abutment means 40, may pass when container engaging means 30 is elevated while in its FIG. 8 broken-line position. Container-engaging means 30 may then be moved inwardly to its FIG. 8 solid-line position by actuatng vehicle power supply 14 to move the lower end 24 of elevator means to its FIG. 8 solid-line position closely adjacent vehicle 12. Elevator means 20 may then be energized to raise container 16 to a position adjacent access opening 18 where suitable means, to be hereinafter described, will tip container 16 to the inverted position shown in FIG. 6. In this position, a suitable locking means 50 automatically locks the container to container engaging means 30 so that the support abutment means will not pass through open-throat U-shaped members 42, 44, as shown in FIG. 6. Locking means 50 includes a pair of lock bars 52, 54, adapted to bridge open-throat U-shaped members 42, 44, respectively. Lock bars 52, 54 are swingably connected to container-engaging means 30 by a shaft 56 having a first end 58 journalled in a hollow boss 60 affixed to U-shaped member 42 by a suitable weldment 62 (FIG. 3) and a second end journalled in a hollow boss 66 affixed to the U-shaped member 44. Shaft 56 includes first and second intermediate portions 68, 70 (FIG. 1) journaled in bearings 72, 74, respectively, rigidly affixed to a rectangular, tubular member or mounting bar 76 by brackets 246, respectively. Lock means 50 also includes a bumper bar 82 engageable by container 14 (FIG. 6) for swinging lock bars 52, 54 about shaft 56, upon movement of container 16 to the substantially inverted position shown in FIG. 6 whereby the lock bars 52, 54 will move into bridging positions in open-throat portions 46, 48.

Figure 4:
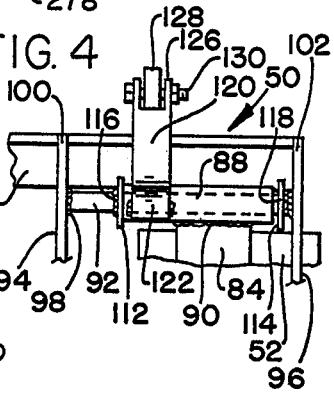
FIG. 4 is an enlarged, partial elevational view of the locking device portion shown in FIG. 2.

The lock bars 52, 54 are each affixed to a bracket 84 (FIG. 2) by a suitable weldment 86. Bracket 84 is secured to a sleeve 88 by a weldment 90 and sleeve 88 is rotatably mounted on a fixed shaft 92, which shaft, in turn, is rigidly affixed to a pair of arms 94, 96 by suitable weldments, like the one shown at 98 for arm 94. Arms 94, 96 have upper ends 100, 102 respectively, affixed to bumper bar 82 by suitable weldments, such as the one shown at 104 for arm 94, and lower ends 106, 108, respectively, affixed to shaft 56 by suitable weldments like the one shown at 110 for arm 94. Longitudinal movement of sleeve 88 on shaft 92 is limited by a pair of thrust washers 112, 114 (FIG. 4) secured to the shaft 92 by weldments 116, 118, respectively. Each sleeve 88 carries an L-shaped arm 120 having a lower end 122 affixed to sleeve 88 by a weldment 124 and an upper, bifurcated end 126 having a roller 128 rotatably mounted thereon by a bolt 130. Rollers 128 are adapted to engage container 16 when it is inverted (FIG. 6) to prevent lock bars 52, 54 from swinging counterclockwise about shaft 92 due to the action of gravity. Rollers 128 have at least an elastomeric face thereon, and each roller forms an abutment to move lock bars 52, 54 across the respective open-throat portions 46, 48.

Figure 2:
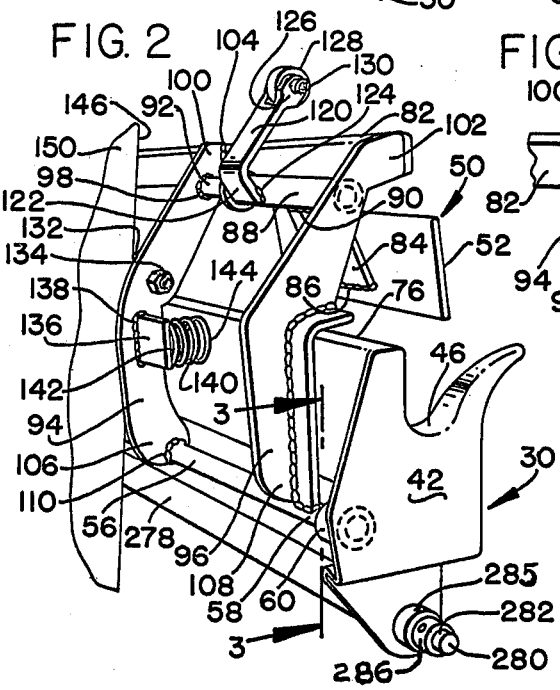
FIG. 2 is an enlarged, perspective view, showing a portion of the container-engaging and the locking portions of the device shown in FIG. 1.
Figure 3:
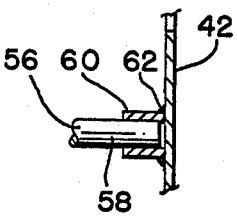
FIG. 3 is an enlarged, cross-sectional view taken along line 3—3 of FIG. 2.

Each arm 94 carries a cam roller 132, rotatably connected thereto by a bolt 134, and a bracket 135, affixed thereto by a weldment 138 (FIGS. 2 and 5). A compression spring 140 has a first end 142 bearing against bracket 136 and a second end 144 bearing against tubular member 76 for biasing cam rollers 132 into engagement with an associated one of the inturned flanges 146 provided on a pair of upstanding masts 150, 152, respectively, forming part of elevator means 20. Masts 150, 152, each includes upper end 22 and lower end 24 of elevator means 20 and are maintained in spaced-apart relationship by an upper transverse tubular brace 156 (FIGS. 1, 6 and 9), an intermediate brace 158 (FIG. 10) and a lower brace 160 (FIG. 1). Each lower end 24 is affixed to a rectangular tubular member 162 (FIGS. 9 and 10) reciprocably mounted in a channel 164 attached to the frame 164 (FIG. 8) of vehicle 12 by a pair of upstanding brackets 166, 168 (FIG. 9) each having a lower 170 affixed to an associated one of the channels 164 by weldments 172, 174. Tubular member 162 is reciprocated by connecting means 28 which comprises an hydraulic cylinder 176 connected to vehicle power supply 14 by a pair of conduits 173, 175 and having a piston rod 178 connected to tubular member 162 by a transverse bar 180, affixed to tubular member 162 by a weldment 182, and a clevis pin 184. Reciprocating friction on tubular member 162 is minimized by a lower roller 186 and an upper roller 188 carried by brackets 190, 192, respectively, affixed to each channel 164 by weldments 194, 196, respectively.

A gear reduction unit 198 is mounted on lower end 24 of mast 152 for receiving the output from an hydraulic motor 200 receiving power from vehicle power supply 14 in the form of hydraulic fluid passing through conduits 202 and 204, as is described in detail in said U.S. Pat. No. 3,910,434. As best seen in FIGS. 1 and 5, a driven shaft 206 has a first end 208 connected to gear reduction unit 198 and a second end 210 journalled in a bearing cup 212 affixed to the lower end 24 of mast 150 by bolts 214. The ends 208, 210 of shaft 206 each carries a sprocket 216 keyed thereto for driving an associated one of a pair of elevator chains 218 trained about an associated upper sprocket 220 keyed to a shaft 222 having a first end 224 journalled in a bearing cup 226 affixed to the upper end 22 of mast 150 by bolts 228 and a second end 240 journalled in a bearing cup 232 affixed to the upper end 22 of mast 148 by bolts 234. Each chain 218 is also trained around an idler sprocket 236 (FIG. 9) carried by a shaft 238 rotatably mounted on masts 150, 152.

Referring now to FIGS. 1, 5, 7, 9 and 10, elevator means 20 includes a channel 240 having flanges 242, 244 between which the rectangular tubular mounting bar 76 on container-engaging means 30 is mounted. An arcuate plate 246 is affixed to each end of channel 240 and includes an upper end 248 which is pivotally connected to elevator chain 218 by a link 250 (FIG. 7). An abutment plate 252 is rigidly affixed to the upper end 248 of each arcuate plate 246 for forming a stop to complimentally engage an elastomeric bumper 254 which is secured to the transverse tubular brace 156 and which prevents further downward movement of container 16 when it is in an inverted position adjacent access opening 18. Abutment plates 252 may be brought into engagement with bumper 254 repeatedly to jar the contents from container 16, if necessary. Each plate 246 also includes a lower end 256 to which an end of a shaft 258 is affixed by a weldment 260. A similar shaft 262 has the ends thereof affixed to the upper end 248 of each plate 246 by weldments, like that shown at 264 in FIG. 7. Each end of the shaft 258, 262 extends through its associated plate 246 where it rotatably receives a guide roller 266 adapted to ride in channel 268 formed by associated ones of the flanges 146, 148 and 270, 272 provided on the masts 150, 152, respectively, for guiding container engaging means 30 during its travel along the upright portions of masts 150, 152 to the upper ends of flanges 272. At this point, the inturned flanges 146, 148 each takes a 180° turn, as shown at 276 in FIG. 9 for the flange 148, so that guide rollers 266 will move container-engaging means 30 on a course which inverts container 16, as shown in FIG. 6. When container 16 moves over the arcs at the upper ends 222 of masts 150, 152, the container 16 will be an elastomeric guide and support roller 278 encompassing a shaft 280 having a first end 282 extending through U-shaped member 42 and journaled in bearing 285, and a second end 184 extending through the U-shaped member 44 and journaled in a bearing 285. A set collar 286 may then be secured to each of the end 282, 284.

OPERATION

Operation of the first form of the device will be readily understood. Assuming that the parts are in the position shown in solid lines in FIG. 8, vehicle power supply 14 (FIG. 9) may be energized to supply fluid under pressure through conduit 175 to hydraulic cylinder 176 causing piston rod 178 to move container-engaging means 30 laterally outward from vehicle 12 over surface 26 to a position whereby the elastomeric guide and support roller 278 is moved into contact rolling relation with container 16 which will position the open-throat portions 46, 48 of the U-shaped members 42, 44 beneath support abutment means 40 on container 16, like the abutment means shown at 40 in FIG. 8, with the elastomeric guide and support rollers 278 being moved into contact relation with the container 16, as shown in dashed outline in FIG. 8. This will position the open-throat portions 46, 48 directly below the abutment support means 40, whereupon, by upward movement of the container engaging means 30, by elevator chains 218, the open-throat portions 46, 48 are guided into engagement with abutment support means 40, without the operator having to rely on manual skill to properly engage the container engaging means 30 with the container 16. The elastomeric roller minimizes the noise, and furthermore, it provides a friction surface to insure that the roller will roll upwardly along the side of the container 16 to cause proper engagement of the container engaging means 30 with the container 16.

The vehicle power supply 14 may then be controlled as more fully explained in said U.S. Pat. No. 3,910,434, to discontinue flow of hydraulic fluid through conduit 175 to cylinder 176 and direct the fluid, under pressure, through conduit 204 (FIG. 9) to hydraulic motor 200 transmitting power through gear reduction unit 198 to shaft 206 (FIG. 1) causing container engaging means 30 to move upwardly in guided relation to elastomeric guide and support roller 278 into engagement with container 16 to lift the container slightly above surface 26. The flow of fluid through conduit 204 to hydraulic motor 200 may then be terminated and cylinder 176 may be pressurized by fluid flowing through conduit 173 to move container-engaging means 30 and container 16 inwardly to a position closely adjacent vehicle 12. The flow of hydraulic fluid to cylinder 176 may then be terminated and fluid may be directed through conduit 204 to hydraulic motor 200 to again elevate container-engaging means 30 and container 16. Guide roller 266 will guide container-engaging means 30 during the upward movement thereof. When guide rollers 266 enter the 180° turn 276, container 16 will be supported by elastomeric guide and support roller 276 until guide rollers 266 start down the other side of the 180° turn 276. Also the respective cam rollers 132 will engage the outer side of the respective flanges 146, 148, simultaneously with the cam rollers 132 entering onto the respective 180° turns 276, will cause a change of distance between the guide rollers 266, and the cam rollers will move the arms 94, 96 outward, due to the change in distance between the cam rollers 132 and the guide rollers 266. This movement will pivot locking means 50 (including arms 94, 96) about the axis of shaft 56 to urge rollers 128 against the side of the container 16 to move bumper bar 82 into contact with container 16. Upon rollers 128 engaging container 16, simultaneously with the cam rollers entering onto the respective 180° turns 276, will cause the pivoting of sleeves 88, the pair of arms 84 and the L-shaped arms 120 to pivot about the axis of shafts 92 to move the lock bars 52, 54 in biased relation into open-throat portions 46, 48 respectively of U-shaped members 42, 44 to retain support abutment means therein. The double pivot action of shaft 56 and sleeve 88 is effective to impart sufficient movement to lock bars 52, 54 to move the lock bars into biased relation in U-shaped members 42, 44 to retain support abutment means 40 in open-throat portions 46, 48 respectively, to automatically lock container-engaging means 30.

Container engaging means 30 will continue its downward movement until abutment plates 252 engage elastomeric bumper 254, whereupon the contents from container 16 should have passed through access opening 18. If necessary, however, the flow of fluid to hydraulic motor 200 may be reversed briefly moving abutment plates 252 away from the elastomeric bumper 254 a short distance, whereupon, the flow of fluid to motor 200 may again be reversed causing plates 252 to re-engage bumper 254 for jarring the contents from container 16. Motor 200 may again be reversed so that elevator chains 218 will carry container-engaging means 20 and container 16 back up around turn 276 and back down the upright portions of masts 150, 152 to the position shown in solid lines in FIG. 8, whereupon motor 200 may be de-energized while container 16 is still slightly above surface 25. Hydraulic cylinder 176 may then again be energized to move masts 150, 152 to the position shown in FIG. 8 in broken lines, whereupon, motor 200 may be energized to lower container 16 to surface 26.

A modified form of the container emptying device is indicated generally at 10A in FIGS. 11–18. Device 10A may be used in combination with vehicle 12 in place of the device 10.

The container emptying device 10A is adapted to empty the contents of trash container 16 (FIGS. 15 and 16) into vehicle 12 through an elevated access opening 18 provided therein. Device 10A includes a suitable elevator means 20A for raising and lowering container 16 and including an upper end 22A adjacent access opening 18 and a lower end 24A adjacent supporting surface 26.

Figure 17:
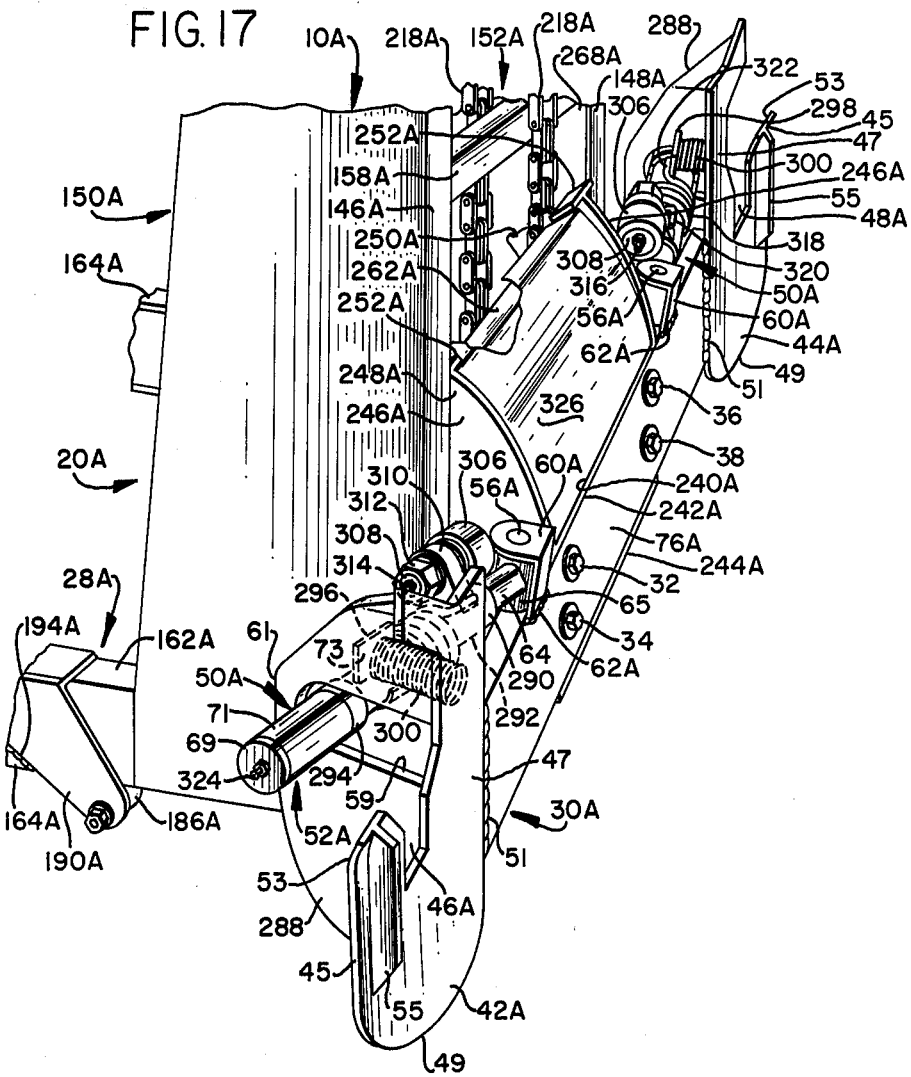
FIG. 17 is an enlarged, partial perspective view showing the container-engaging portion of the device connected to the elevator portion of the device.
Figure 18:
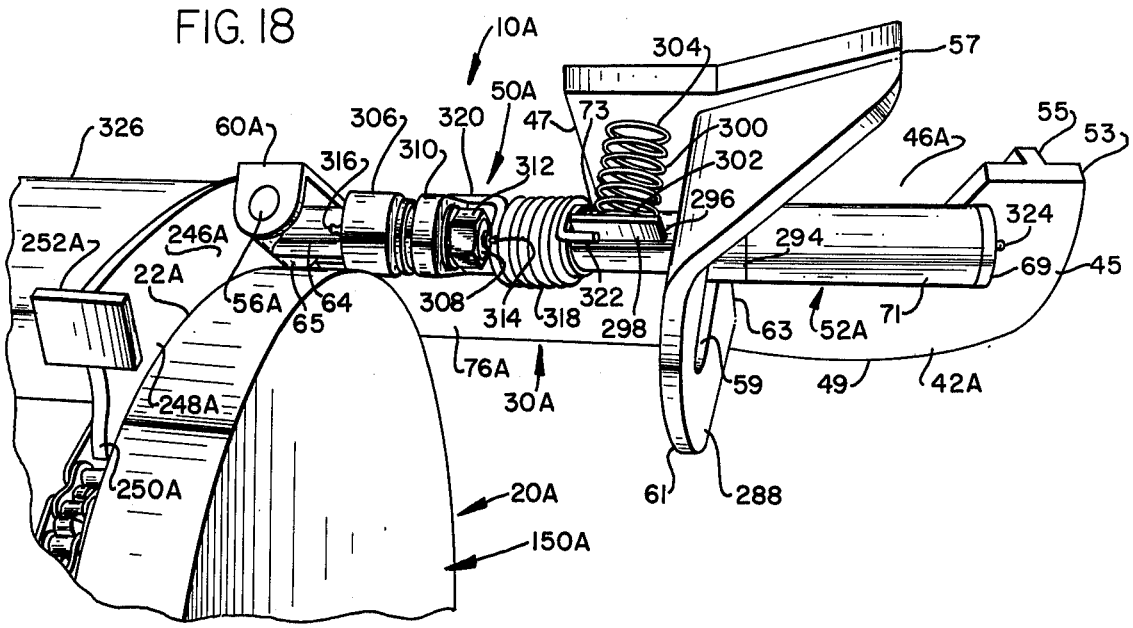
FIG. 18 is an enlarged, partial perspective view of a portion of the container-engaging and the locking portions of the device of FIG. 11 with parts in an elevated position.

Container emptying device 10A also includes a suitable connecting means, indicated generally at 28A in FIG. 17, for connecting the elevator means 20A to the vehicle power supply, shown at 14 in FIG. 9, for moving at least the lower end 24A of elevator means 20A over surface 26 between a first position closely adjacent to vehicle 12, as shown in solid lines in FIG. 15, and a second position spaced laterally outwardly from vehicle 12 and closely adjacent container 16, as shown in broken lines in FIG. 15.

Device 10A includes a container-engaging means 30A which may be quickly and easily connected to elevator means 20A by a plurality of bolts 32, 34, 36 and 38 facilitating interchanging container engaging means 30A with other container-engaging means. Container-engaging means 30A is adapted to mechanically engage the abutment means 40 when the elevator means 20A is moved to the position shown in broken lines in FIG. 15 by power transmitted from vehicle 12 to connecting means 28A. Abutment means 40 includes an arm 41 affixed to each sidewall 16A, 16B of container 16 and a roller 43 rotatably mounted on the free end 41A of each arm 41. Each free end 41A extends to a position in front of container 16 and the axis of rotation of each roller 43 is normal to the longitudinal axis of its associated arm, whereby a stop member is provided normal to each arm at its free end.

As best shown in FIGS. 11–13 and 15–18, container-engaging means 30A includes a pair of hooks or U-shaped members 42A, 44A having open-throat portions 46A, 48A, respectively, through which an associated one of the free ends 41A may pass when container engaging means 30A is elevated while in its FIG. 15 broken-line position. Container-engaging means 30A may then be moved inwardly to its FIG. 15 solid-line position by actuating vehicle power supply 14 (FIG. 9) to move the lower end 24A of elevator means 20A to its FIG. 15 solid-line positon closely adjacent vehicle 12. Elevator means 20A may then be energized to raise container 16 to a position adjacent access opening 18 where suitable means, to be hereinafter described, will tip container 16 to the inverted position shown in FIG. 16. In this position, a suitable locking means 50A automatically locks the container to container engaging means 30A so that free ends 41A will not pass through open-throat portions 46A, 48A of U-shaped members 42A, 44A. Locking means 50A includes a pair of lock bars 52A, 54A, adapted to engage free ends 41A. Lock bars 52A, 54A are swingably connected to container-engaging means 30A by pins 56A each journaled in a bracket 60A affixed to a rectangular, tubular member or mounting bar 76A by weldments 62A.

Figure 12:
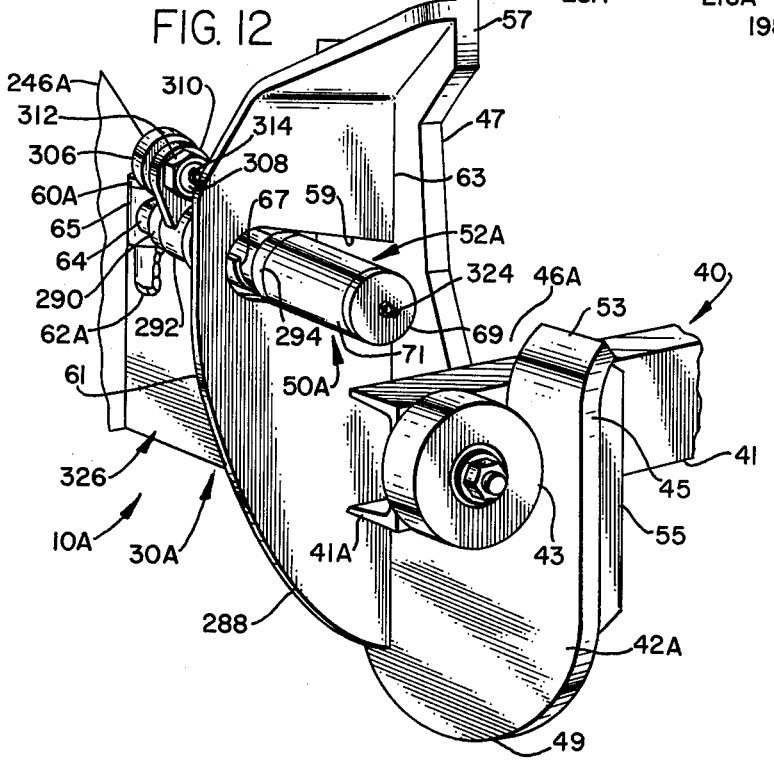
FIG. 12 is an enlarged, perspective view, showing a portion of the container-engaging and the locking portions of the device shown in FIG. 11.

The U-shaped members 42A, 44A each includes a short leg 45, a long leg 47 and a bight portion 49. Long leg 47 is affixed to mounting bar 76A by a weldment 51 (FIG. 17) in a manner such that legs 45, 47 and bight portion 49 lie in a plane normal to the plane of arm 41, as best seen in FIG. 12. It may be noted that this position of members 42A, 44A is also normal to the position of members 42, 44 in the first form of the invention. Each leg 45 has an upper end 53 which is curved outwardly to facilitate engaging roller 43 behind leg 45, which is re-enforced by a gusset plate 55. As is clear from FIGS. 12, 15 and 16, leg 45 engages roller 43 between the roller and container 16. Each leg 47 has an upwardly, outwardly extending member 57 which diverge from each other to faciltate aligning container engaging means 30A. Each leg 47 is re-enforced by a gusset plate 288 which is provided with a slot 59 extending downwardly from adjacent the rear edge 61 to the front edge 63 to accomodate an associate one of the lock bars 52A, 54A and the path taken thereby when it moves to its locking position against its arm 41.

Lock bars 52A, 54A each includes a shaft 64 affixed to a hollow boss 65 encompassing an associated one of the pins 56A, which are inclined slightly outwardly away from elevator means 20A as shown in FIG. 17, so that lock bars 52A, 54A will swing downwardly toward arms 41, in a manner to be hereinafter described. A first collar 290 is affixed to each shaft 64 near its boss 65 and a second collar 67 is affixed to an intermediate portion of each shaft for controlling the axial position of a first sleeve 292 rotatably mounted on shaft 64. A third collar 69 is affixed to each shaft 64 at its free end and a fourth collar 294 is affixed to shaft 64 a predetermined distance from collar 67 for controlling the axial position of a second sleeve 71 rotatably mounted on the free end (not shown) of each shaft 64. A lug 296 is affixed to each shaft 64 between sleeves 292, 71 and includes a front face 73 and a rear face 298.

Lock bars 52A, 54A are each normally maintained in the retracted position shown in FIGS. 13 and 17 by a compression spring 300 having a first end 302 bearing against face 73 of lug 296 and a second end 304 bearing against leg 47 of an associated one of the U-shaped members 42A, 44A. Each lock bar may be moved to the container-locking position shown in FIG. 18 for bar 52A by a roller-type cam 306 (FIGS. 11–13 and 17–18) rotatably mounted on a bolt 308 secured to a bracket 310 by a nut 312 and lubricated through a pair of grease fittings 314, 316. Bracket 310 is affixed to sleeve 292 and cam 306 lightly engages an associated one of the inturned flanges 146A, 148A on a pair of upstanding masts 150A, 152A, respectively, forming part of elevator means 20A. Thus, when container-engaging means 30A starts over the upper end 22A of elevator means 20A, the weight of container 16 will bring cams 306 into engagement with their associated flanges 146A, 148A with sufficient force to impart a rotating force to each sleeve 292 on its shaft 46. A torsion spring 318 translates this rotating force on each sleeve into a swinging of each shaft 46 on its pin 56A for overcoming the bias of compression springs 300 so that each lock bar 52A, 54A will move down its slots 59 and into engagement with its aim 41. Each torsion spring 318 has first and second ends 320, 322, respectively, engaging an associated one of the brackets 310 and lugs 296, respectively. Each spring 318 and its associated parts permits each cam and its bracket to move forward (as viewed in FIG. 13) without moving an associated one of the lock bars 52A, 54A when the bars are in a position where damage would be caused by their movement.

A grease fitting 324 may be provided on the free end of each shaft 64 for lubricating sleeves 292, 71. Cams 306 and sleeves 71 may be covered with a suitable elastomeric material if desired.

Figure 11:
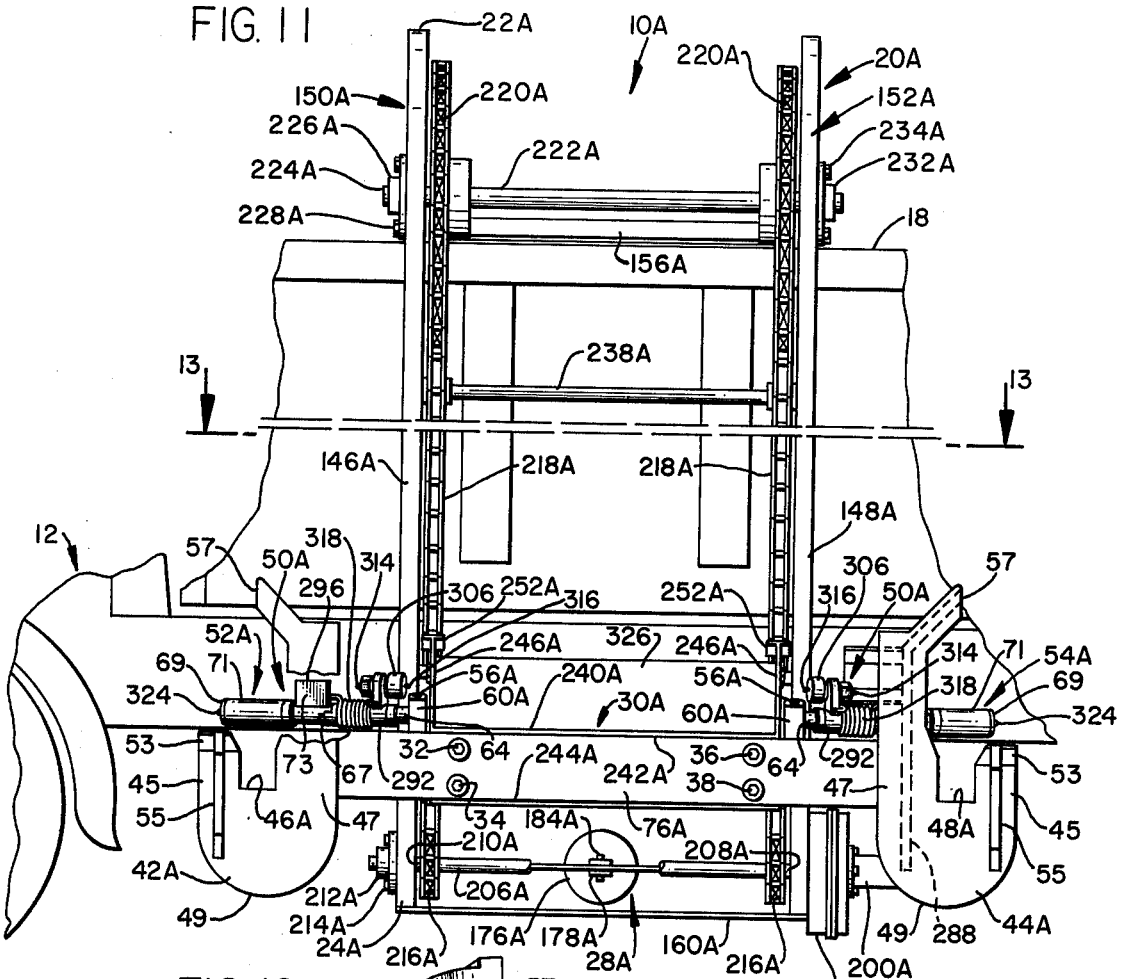
FIG. 11 is a front elevational view of a container emptying device constituting a modified form of the present invention having portions thereof foreshortened for clarity and showing the device in position on the side of a vehicle shown in side elevation with portions broken away.

Masts 150A, 152A are maintained in spaced-apart relationship by an upper transverse tubular brace 156A (FIGS. 11 and 16), an intermediate brace 158A (FIG. 17) and a lower brace 160A (FIG. 11). Each lower end 24A is affixed to a rectangular tubular member 162A (FIG. 17) reciprocably mounted in a channel 164A attached to vehicle 12 in the manner described in connection with the first form of the invention. Tubular members 162A is reciprocated by connecting means 28A which comprises an hydraulic cylinder 176A (FIG. 11) connected to the aforementioned vehicle power supply and having a piston rod 178 connected to tubular member 162A by a transverse bar 180A affixed to tubular member 162A by a clevis pin 184A. Reciprocating friction on tubular member 162A is minimized by a lower roller 186A (FIG. 17) carried by a bracket 190A affixed to each channel 164A by a weldment 194A.

A gear reduction unit 198A (FIGS. 11 and 13) is mounted on lower end 24A of mast 152A for receiving the output from an hydraulic motor 200A receiving power from the vehicle power supply in the form of hydraulic fluid passing through conduits 202A and 204A as is described in detail in said patent No. 3,910,434. As best seen in FIGS. 11 and 13, a driven shaft 206A has a first end 208A connected to gear reduction unit 198A and a second end 210A journaled in a bearing cup 212A affixed to the lower end 24A of mast 150A by bolts 214A. The ends 208A, 210A of shaft 206A each carries a sprocket 216A keyed thereto for driving an associated one of a pair of elevator chains 218A trained about an associated upper sprocket 220A keyed to a shaft 222A having a first end 224A journaled in a bearing cup 226A affixed to the upper end 22A of mast 150A by bolts 228A and a second end 230A journaled in a bearing cup 232A affixed to the upper end 22A of mast 152A by bolts 234A. Each chain 218A is also trained around an idler sprocket 236A (FIG. 16) carried by a shaft 238A rotatably mounted on masts 150A, 152A.

Referring now to FIGS. 11–14B and 16–18, elevator means 20A includes a first arcuate plate 326 provided with a channel 240A having flanges 242A, 244A between which the rectangular tubular mounting bar 76A on container-engaging means 30A is mounted. Another arcuate plate 246A is affixed to each end of the first plate 326 and includes an upper end 248A which is connected to elevator chain 218A by a bracket 250A extending from end 248A. An abutment plate 252A is rigidly affixed to the upper end 248A of each arcuate plate 246A for forming a stop to complimentally engage an elastomeric bumper 254A (FIG. 16) which is secured to the transverse tubular brace 156A and which prevents further downward movement of container 16 when it is in an inverted position adjacent access opening 18. Abutment plates 252A may be brought into engagement with bumper 254A repeatedly to jar the contents from container 16, if necessary. Each plate 246A also includes a lower end 256A (FIGS, 14, 14B and 16) to which an end of a shaft 258A is affixed. A similar shaft 262A has its ends affixed to the upper end 248A of each plate 246A (FIGS. 13, 14, 14A, 16 and 17) and each end of the shafts 258A, 262A extends through its associated plate 245A where it rotatably receives a guide roller 266A adapted to ride in channel 268A formed by associated ones of the flanges 146A, 148A and 270A, 272A provided on the masts 140A, 152A respectively, for guiding container engaging means 30A during its travel along the upright portions of masts 150A, 152A to the upper ends 327 (FIG. 16) of flanges 270A, 272A. At this point, the inturned flanges 146A, 148A each takes a 180° turn, as shown at 276A in FIG. 16 for the flange 148A, so that guide rollers 266A will move container-engaging means 30A on a course which inverts container 16, as shown in FIG. 16. When container engaging means 30A moves over the arcs at the upper ends 22A of masts 150A, 152A, brackets 250A on plates 246A will be engaged in notches provided in upper sprockets 220A, as shown at 328 for sprocket 220A on mast 152A (FIG. 16). Thus, sprockets 220A will carry the weight of container 16 and container engaging means 30A

While the particular container emptying devices herein shown and described in detail are fully capable of attaining the objects and providing the advantages hereinbefore stated, it is to be understood that they are merely illustrative of the presently preferred embodiments of the invention, and that no limitations are intended to the details of construction or design herein shown and described, other than as defined in the appended claims, which form a part of this disclosure. Whenever the term "means" is employed in these claims is to be interpreted as defining the corresponding structure illustrated and described in this specification or the equivalent of the same.

What is claimed is:

1. In combination with a vehicle having an elevated access opening, apparatus for emptying refuse into the vehicle through said access opening, comprising:

a refuse container for holding said refuse, said refuse container having a pair of sidewalls and a container support arm affixed to each of said sidewalls, each support arm having a free end extending to a position in front of said container, and a roller rotatably mounted on each of said free ends of said support arms, the axis of rotation of each roller being normal to the longitudinal axis of its associated arm;

elevator means including an endless carrier for raising and lowering said container; and container-engaging means connected to said endless carrier, said container-engaging means including a U-shaped support member having an upwardly-facing, open-throat portion for engaging a part of the free end of each of said container support arms behind its roller said part being is between the roller and the container.

2. A combination as stated in claim 1 wherein each of said U-shaped support members comprises:

a short leg, a long leg and a bight portion lying in a plane normal to the longitudinal axes of said container support arms.

3. A combination as stated in claim 2 including an upwardly, outwardly extending flange on the upper end of each of said long legs for guiding said container-engaging means into position adjacent said container.

4. A combination as stated in claim 1 including:

means for automatically locking said refuse container to said container engaging means when said container is inverted to empty said refuse into said vehicle, said locking means including a lock bar swingably mounted on said container-engaging means adjacent each of said U-shaped support members for blocking its open-throat portion.

5. In combination with a vehicle having an elevated access opening, apparatus for emptying refuse into the vehicle through the elevated access opening, comprising:

A. a refuse container for holding said refuse, said refuse container having a pair of sidewalls and a container support arm affixed to each sidewall, each support arm having a free end extending to a position in front of said container and a stop member mounted on each of said free ends of said support arms;

B. elevator means including an endless carrier for raising and lowering said container; and C. container-engaging means connected to said endless carrier, said container-engaging means including:

1. a rectangular, elongated mounting bar having first and second ends; and 2. a first U-shaped member affixed to said first end of said mounting bar and a second U-shaped member affixed to said second end of said mounting bar, each of said U-shaped members having a short leg, a long leg and a bight portion, each of said long legs being affixed to an associated one of said ends of said mounting bar in a manner such that said legs and said bight portion lie in a plane normal to the longitudinal axis of an associated one of said support arms with said bight portion lowermost and with said legs upstanding in spaced apart relationship for defining an open-throat portion which can support an associated one of said free ends of said support arms whereby each said support arm is supported by said portion between said container and said stop member.

6. A combination as stated in claim 5 including locking means for automatically locking said container to said container-engaging means so that said free ends of said support arms will not pass through said open-throat portions when said container is inverted to empty said refuse into said vehicle, said locking means comprising:

a pair of lock bars;

a pivot pin swingably connecting one of said lock bars to said mounting bar adjacent each of said first and second ends, each of said lock bars including a free end adjacent an associated one of said open-throat portions;

an upstanding lug affixed to each of said lock bars adjacent an associated one of said long legs;

a compression spring for biasing each of said lock bars to a position away from its associated open-throat portion, each compression spring having a first end bearing against an associated one of said lugs and a second end bearing against an associated one of said long legs; and a roller-type cam affixed to each of said lock bars adjacent said elevator means for contact therewith as said container approaches said inverted position, whereby said cam will overcome the bias of said compression spring and swing its associated lock bar into engagement with its associated support arm across an associated one of said open-throat portions.

7. A combination as stated in claim 6 wherein each of said cams is affixed to a sleeve rotatably mounted on its lock bar adjacent its lug and wherein each lock bar includes a torsion spring having a first end connected to one of said cams and a second end connected to one of said lugs in a manner such that rotation of said sleeve by said cam will be prevented until said cam is subjected to a force by said elevator means exceeding a predetermined amount.

8. In combination with a vehicle having an elevated access opening, apparatus for emptying refuse into the vehicle through said access opening, comprising:

a refuse container for holding said refuse, said refuse container having a pair of sidewalls and a container support arm affixed to each of said sidewalls, each support arm having a free end extending to a position in front of said container, and a stop member mounted on each of said free ends of said support arms normal thereto extending on the opposite side of its associated arm from the container;

elevator means including an endless carrier for raising and lowering said container; and container-engaging means connected to said endless carrier, said container-engaging means including a U-shaped support member having an upwardly-facing, open-throat portion for engaging the free end of each of said container support arms between its stop member and the container, said stop member serving to stop the motion of said support arm away from said portion when said arm is engaged by said portion.

9. In combination with a vehicle having an elevated access opening, apparatus for emptying refuse into the vehicle through the elevated access opening, comprising:

A. a refuse container for holding said refuse, said refuse container having a pair of sidewalls and a container support arm affixed to each sidewall, each support arm having a free end extending to a position in front of said container;

B. elevator means including an endless carrier for raising and lowering said container; and C. container-engaging means connected to said endless carrier, said container-engaging means including:

1. a rectangular, elongated mounting bar having first and second ends; and 2. a first U-shaped member affixed to said first end of said mounting bar and a second U-shaped member affixed to said second end of said mounting bar, each of said U-shaped members having a pair of legs and a bight portion, one leg of each pair of said legs being affixed to an associated one of said ends of said mounting bar in a manner such that said legs and said bight portion lie in a plane normal to the longitudinal axis of an associated one of said support arms with said bight portion lowermost and with said legs upstanding in spaced-apart relationship for defining an open-throat portion through which an associated one of said free ends of said support arms may pass; and (D) means to prevent said support arm from moving transversely away from and out of said portion.

* * * * *